US010460642B2

(12) United States Patent
Lin et al.

(10) Patent No.: US 10,460,642 B2
(45) Date of Patent: Oct. 29, 2019

(54) NOISE REDUCTION IN LED SENSING CIRCUIT FOR ELECTRONIC DISPLAY

(71) Applicant: APPLE INC., Cupertino, CA (US)

(72) Inventors: Hung Sheng Lin, San Jose, CA (US); Jiayi Jin, Cupertino, CA (US); Wei H. Yao, Palo Alto, CA (US); Hyunwoo Nho, Stanford, CA (US); Guangmao Xing, San Jose, CA (US); Weijun Yao, San Jose, CA (US); Xiaofeng Wang, San Jose, CA (US); Yafei Bi, Palo Alto, CA (US); Haifeng Li, Campbell, CA (US)

(73) Assignee: Apple Inc., Cupertino, CA (US)

( * ) Notice: Subject to any disclaimer, the term of this patent is extended or adjusted under 35 U.S.C. 154(b) by 474 days.

(21) Appl. No.: 15/199,315

(22) Filed: Jun. 30, 2016

(65) Prior Publication Data

US 2018/0005562 A1 Jan. 4, 2018

(51) Int. Cl.

| | |
|---|---|
| ***G09G 3/20*** | (2006.01) |
| ***G09G 3/3208*** | (2016.01) |
| ***G09G 3/3233*** | (2016.01) |

(52) U.S. Cl.

CPC ..... *G09G 3/2007* (2013.01); *G09G 3/3208* (2013.01); *G09G 3/3233* (2013.01); *G09G 2310/027* (2013.01); *G09G 2310/06* (2013.01); *G09G 2310/066* (2013.01); *G09G 2310/08* (2013.01); *G09G 2320/029* (2013.01); *G09G 2320/0233* (2013.01); *G09G 2320/0693* (2013.01)

(58) Field of Classification Search

CPC .. G09G 3/2007; G09G 3/3233; G09G 3/3208; G09G 2310/066; G09G 2320/0233; G09G 2320/029; G09G 2310/027; G09G 2310/08; G09G 2310/06; G09G 2320/0693

See application file for complete search history.

(56) References Cited

U.S. PATENT DOCUMENTS 6,040,812 A * 3/2000 Lewis ..... G09G 3/3648 345/691
6,243,034 B1 * 6/2001 Regier ..... H03M 1/145 341/155

(Continued)

FOREIGN PATENT DOCUMENTS

WO 2014/174472 A1 10/2014

*Primary Examiner* — Grant Sitta
(74) *Attorney, Agent, or Firm* — Fletcher Yoder P.C.

(57) ABSTRACT

Systems, methods, and devices are provided to reduce noise present in sensing circuits used for calibrating light emitting diodes (e.g., organic light emitting diodes) in electronic display devices. Such a system may include a display that renders image data using self-emissive pixels. Values on the pixels may be sensed using a current source that outputs a current and a comparator that receives the current. The comparator changes states when a voltage signal output by the capacitor crosses a first threshold voltage or a second threshold voltage. A controller receives a first time when the comparator component changes states based on the voltage signal, receives a second time when the comparator component changes states based on the voltage signal, determines a current value based on the first time and the second time, and calibrates a pixel based on the current value.

24 Claims, 17 Drawing Sheets

(56) References Cited

U.S. PATENT DOCUMENTS 6,411,273 B1* 6/2002 Nakamura ..... G09G 3/2011 345/205
9,106,888 B2 8/2015 Chou
9,215,472 B2 12/2015 Orr et al.
9,218,639 B2 12/2015 Cote et al.
9,224,186 B2 12/2015 Rygh et al.
9,224,187 B2 12/2015 Cote et al.
9,270,999 B2 2/2016 Cote et al.
9,292,899 B2 3/2016 Schaub et al.
9,299,122 B2 3/2016 Okruhlica et al.
9,305,325 B2 4/2016 Cheng et al.
9,336,558 B2 5/2016 Cote et al.
9,351,003 B2 5/2016 Cote et al.
9,373,280 B2* 6/2016 Yoon ..... G09G 3/3233
9,380,312 B2 6/2016 Cote et al.
9,780,129 B2* 10/2017 Eshel ..... H03K 5/1252
2003/0174083 A1* 9/2003 Mayfield ..... H03M 1/1019 341/166
2008/0001855 A1* 1/2008 Hamer ..... G09G 3/3233 345/76
2008/0180365 A1* 7/2008 Ozaki ..... G09G 3/3233 345/76
2009/0115795 A1* 5/2009 Pae ..... G09G 3/3283 345/589
2010/0141667 A1 6/2010 Chiou et al.
2010/0176855 A1* 7/2010 Huffman ..... G09G 3/2014 327/166
2011/0279444 A1* 11/2011 Chung ..... G09G 3/3233 345/214
2013/0016091 A1* 1/2013 Kato ..... G09G 3/3225 345/419
2014/0152642 A1* 6/2014 Kim ..... G09G 3/3233 345/212
2014/0198092 A1* 7/2014 Azizi ..... G09G 3/006 345/212
2014/0347310 A1* 11/2014 Hargreaves ..... G06F 3/044 345/174
2015/0048881 A1* 2/2015 Kwon ..... H03H 19/004 327/554
2015/0077314 A1* 3/2015 Kim ..... G09G 3/3233 345/76
2015/0092833 A1 4/2015 Ku et al.
2015/0092843 A1 4/2015 Millet et al.
2015/0092855 A1 4/2015 Chou et al.
2015/0170569 A1 6/2015 Han et al.
2015/0187094 A1 7/2015 Lee et al.
2015/0279274 A1* 10/2015 Pyo ..... G09G 3/3233 345/77
2016/0007038 A1 1/2016 Chou et al.
2016/0012798 A1* 1/2016 Oh ..... G09G 3/325 345/205
2016/0021385 A1 1/2016 Chou et al.
2016/0065969 A1 3/2016 Cheng et al.
2016/0065973 A1 3/2016 Cote et al.
2016/0078805 A1* 3/2016 Woo ..... G09G 3/3225 345/78
2016/0078813 A1* 3/2016 Mizukoshi ..... G09G 3/3283 345/76
2016/0078824 A1* 3/2016 Meador ..... G09G 3/3433 345/212
2016/0163255 A1 6/2016 Kim et al.

* cited by examiner

NOISE REDUCTION IN LED SENSING CIRCUIT FOR ELECTRONIC DISPLAY

BACKGROUND

The present disclosure relates generally to electronic display devices that depict image data. More specifically, the present disclosure relates to systems and methods for reducing noise present in sensing circuits used for calibrating light emitting diodes (e.g., organic light emitting diodes) in electronic display devices.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As electronic displays are employed in a variety of electronic devices, such as mobile phones, televisions, tablet computing devices, and the like, manufacturers of the electronic displays continuously seek ways to improve the consistency of colors depicted on the electronic display devices. For example, given variations in manufacturing or the various noise sources present within a display device, different pixels within a display device might emit a different color value or gray level even when provided with the same electrical input. It is desirable, however, for the pixels to uniformly depict the same color or gray level when the pixels programmed to do so to avoid visual display artifacts due to inconsistent color.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain electronic display devices, light emitting diodes such as organic light-emitting diodes (OLEDs) or micro-LEDs (μLEDs) may be employed as pixels to depict a range of gray levels for display. However, due to various properties associated with the operation of these pixels within the display device, a particular gray level output by one pixel in a display device may be different from a gray level output by another pixel in the same display device upon receiving the same electrical input. As such, the electrical inputs may be calibrated to account for these differences by sensing the electrical values that get stored into the pixels and adjusting the input electrical values accordingly. Since a more accurate and/or precise determination of the sensed electrical value in the pixel may be used to obtain a more consistent and/or exact calibration, the present disclosure details various systems and methods that may be employed to filter noise that may be present within a signal of the sensed electrical value in one or more pixels.

One way to obtain a more accurate and/or precise measurement of the sensed electrical value in a pixel involves filtering noise using multiple samples. For instance, in one embodiment, a calibration system within the display device may provide a ramp voltage signal to a comparator component associated with a pixel. The calibration system may be designed such that when the voltage signal provided to the comparator component reaches a threshold, the comparator component may then keep the voltage signal constant at the threshold value. After the voltage signal reaches the threshold value, an averaging component coupled to the comparator component may obtain multiple samples of the voltage signal being output by the comparator component. Using the multiple samples of the voltage signal, which may be fluctuating within some range of voltage values due to noise present on the voltage signal, the averaging component may determine an average value of the obtained samples to determine a voltage value of the voltage signal that corresponds to the threshold. Using this determined voltage value, a display driver circuit may adjust the input voltage provided to the corresponding pixel to calibrate the respective pixel with other pixels within the display device.

In another embodiment, the calibration system may provide a ramp digital-to-analog (DAC) voltage signal to a comparator component associated with a pixel. The ramp DAC voltage signal may be a step function that may step down a voltage signal at uniform increments, such that a counter component may count each voltage step with respect to a clock signal provided by a clock component. When the ramp DAC voltage signal reaches a threshold voltage, the comparator component may switch states (e.g., turn off). When the comparator component switches states, the counter component may indicate a count at which the comparator component switched states. The count may then be used to determine a voltage value of the ramp DAC voltage signal when the ramp DAC voltage signal reached the threshold voltage. The determined voltage value may then be used to calibrate the respective pixel with other pixels within the display device.

In another embodiment, the calibration system may include a current source to provide a constant current to a pixel and a capacitor coupled to a comparator component. Using the constant current, the capacitor may output a time-to-digital conversion (TDC) voltage signal that may decrease linearly with respect to time. The comparator component may receive the TDC voltage signal and switch states (e.g., turn off) when the TDC voltage signal reaches a threshold voltage. The time at which the comparator component switches states may then be used to determine the voltage value of the TDC voltage signal that corresponds to the threshold voltage. The determined voltage value may then be used to calibrate the respective pixel with other pixels within the display device.

In another embodiment, when the comparator component changes states (e.g., turns off) due to the input voltage signal exceeding or falling below a threshold voltage, noise present on the input signal may cause the comparator component to switch states again. That is, if the comparator component initially changes states when the input voltage signal falls below the threshold voltage, the comparator component may change states again if the input voltage signal is noisy and exceeds the threshold voltage after falling below the threshold voltage. In this case, the clock time or count associated with each time the comparator component changes states may be recorded and the corresponding voltage values associated with each comparator state change may be averaged to determine a voltage value that more accurately represents the voltage at the comparator component when the input voltage signal reached the threshold voltage. The determined voltage value may then be used to calibrate the respective pixel with other pixels within the display device.

Various refinements of the features noted above may exist in relation to various aspects of the present disclosure.

Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
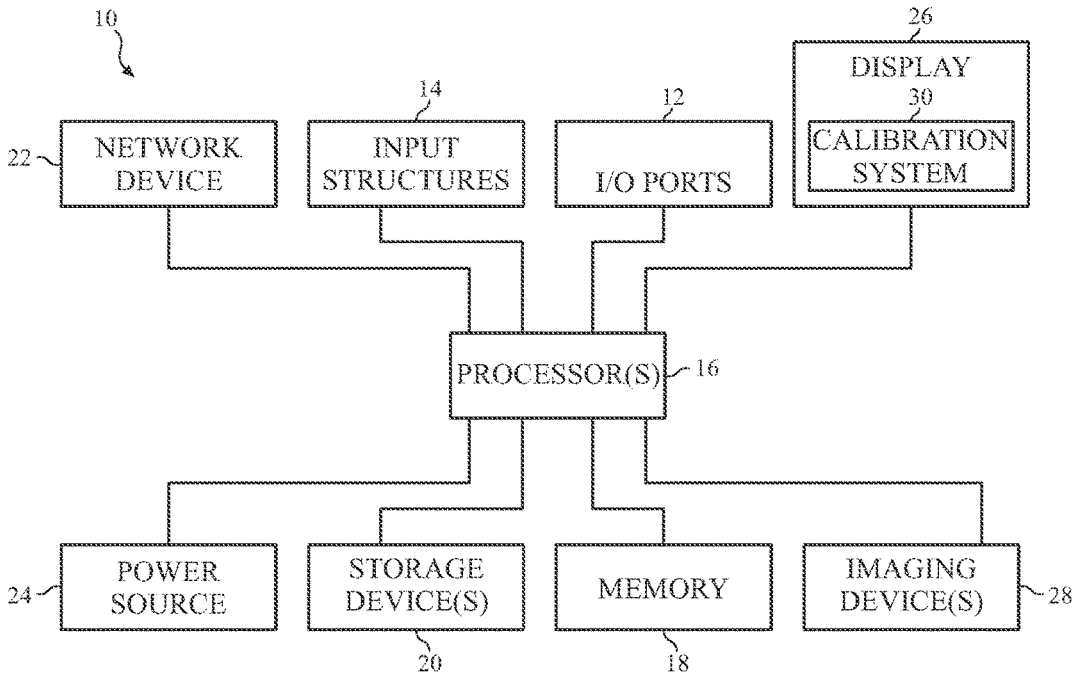
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, in certain embodiments, a calibration system (e.g., circuit) may be coupled to a pixel of an electronic display. Generally, the voltage signal provided to the pixel is used to generate a particular gray level. However, due noise present on the voltage signal, the pixel may depict a different gray level than expected. That is, each pixel within the display may depict a different gray level when the same voltage signal is provided. To calibrate the voltage signal provided to each pixel, in one embodiment, the calibration system may average the voltage signal provided to the pixel to filter the noise component of the voltage signal. In another embodiment, the calibration system may use a ramp digital-to-analog converter (DAC) voltage signal, a clock, and a comparator component to track a number of counts of the ramp DAC voltage signal provided to the comparator component before the comparator component changes states. Using the number of counts, the calibration system may determine a noise-filtered voltage value that corresponds to a threshold voltage of the comparator component. The noise-filtered voltage value may then be used to calibrate the voltage provided to the pixel.

In yet another embodiment, the calibration system may use a time-to-digital converter (TDC) voltage signal and a comparator component to determine times in which the comparator component changes states. Using the times at which the comparator component changes states, the calibration system may determine a noise-filtered voltage value that corresponds to a threshold voltage of the comparator component. The noise-filtered voltage value may then be used to calibrate the voltage provided to the pixel.

In yet another embodiment, the comparator component of a calibration system may switch states multiple times when the input voltage signal is within a range of the threshold voltage of the comparator component. In this case, the calibration system may sample the voltage value received at the comparator component each time the comparator component changes states. The calibration system may then determine an average of the sampled voltage values to determine a noise-filtered voltage value provided to the pixel that corresponds to the threshold voltage.

Although each of the brief descriptions of the embodiments mentioned above has been described independently, it should be noted that, in some embodiments, the calibration may employ a combination of two or more of the proposed techniques to filter the noise of the voltage signal provided to a pixel. Accordingly, although the following description of various techniques for filtering noise of a voltage signal and calibrating the voltage signal provided to a pixel, it should be understood that two or more of the following techniques and circuits may be employed together to filter noise from the voltage signal and calibrate the voltages provided to pixels within a display.

By way of introduction, FIG. 1 is a block diagram illustrating an example of an electronic device 10 that may include the calibration system mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, networking device 22, power source 24, display 26, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. In one embodiment, the display 26 may include self-emissive pixels such as organic light emitting diodes (OLEDs) or micro-light-emitting-diodes (μ-LEDs). In addition, the display 26 may include switchable retarder pixels, each of which corresponds to one or more of the self-emissive pixels. The switchable retarder pixels may use liquid crystal materials to selectively retard or permit outside light. Using the switchable retarder pixels may thus allow for a high-contrast mode of operation of the display 26.

Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the electronic device 10 may include a calibration system 30, which may be separate or integral to the display 26. The calibration system 30 may include a chip, such as processor or ASIC, that may control various aspects of the display 26. For instance, the calibration system 30 may use a voltage signal that is to be provided to a pixel of the display 26 to calibrate the gray level depicted by the pixel. Generally, the voltage signal provided to each pixel of the display 26 may include noise, such that the voltage provided to one pixel may result in one gray level, while the same voltage applied to another pixel may result in a different gray level. As such, the calibration system 30 may filter the noise from the voltage signal, such that the pixels of the display 26 are calibrated with each other.

Figure 2:
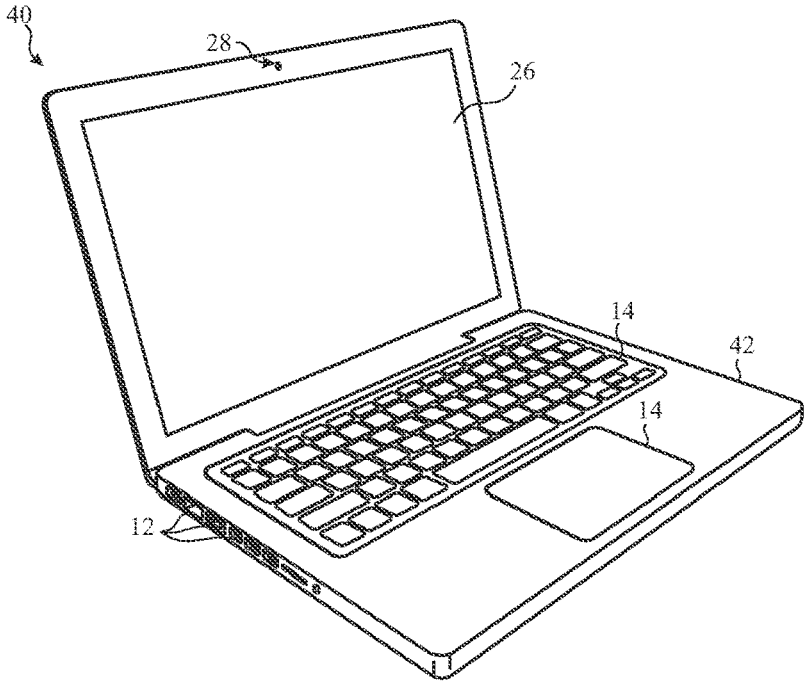
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 24), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
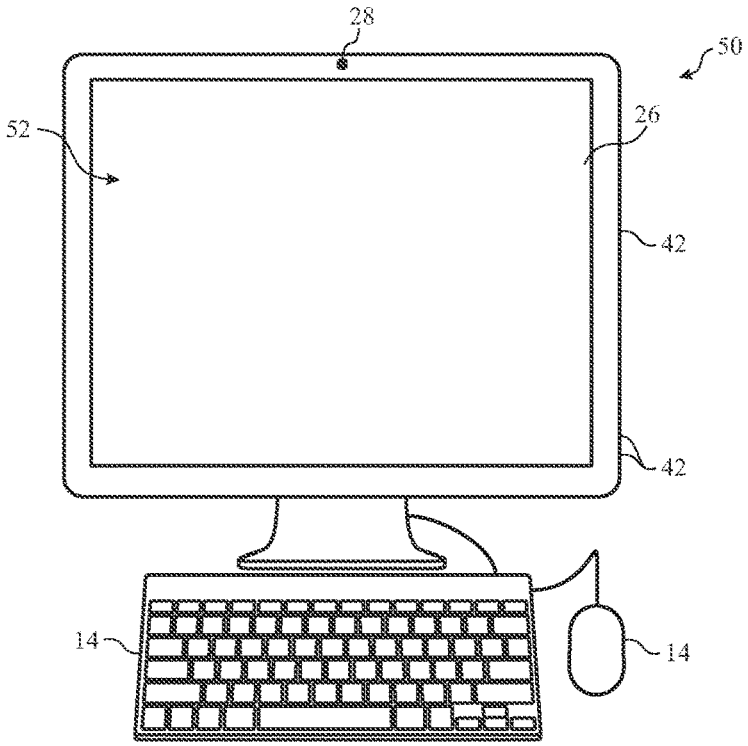
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
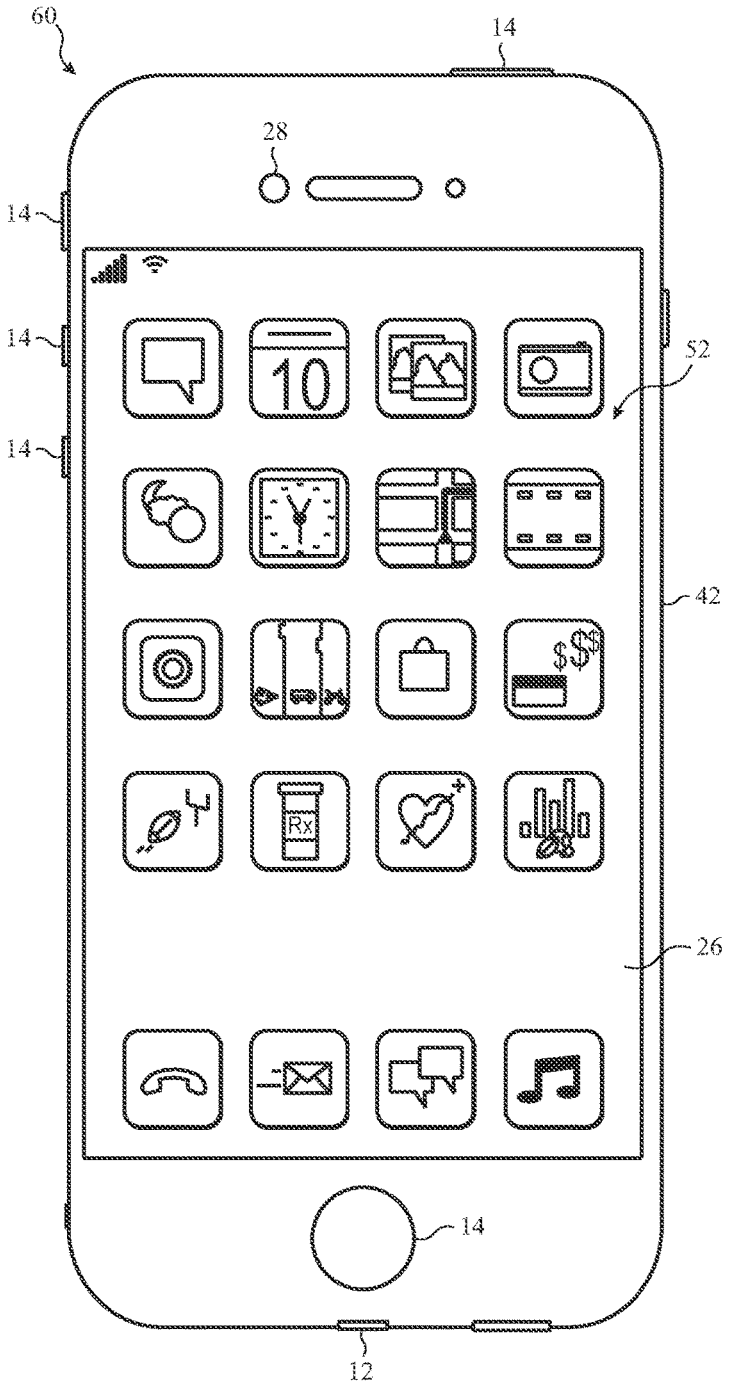
FIG. 4 is a front view of the electronic device of FIG. 1 in the form of a handheld portable electronic device, in accordance with embodiments described herein.
Figure 5:
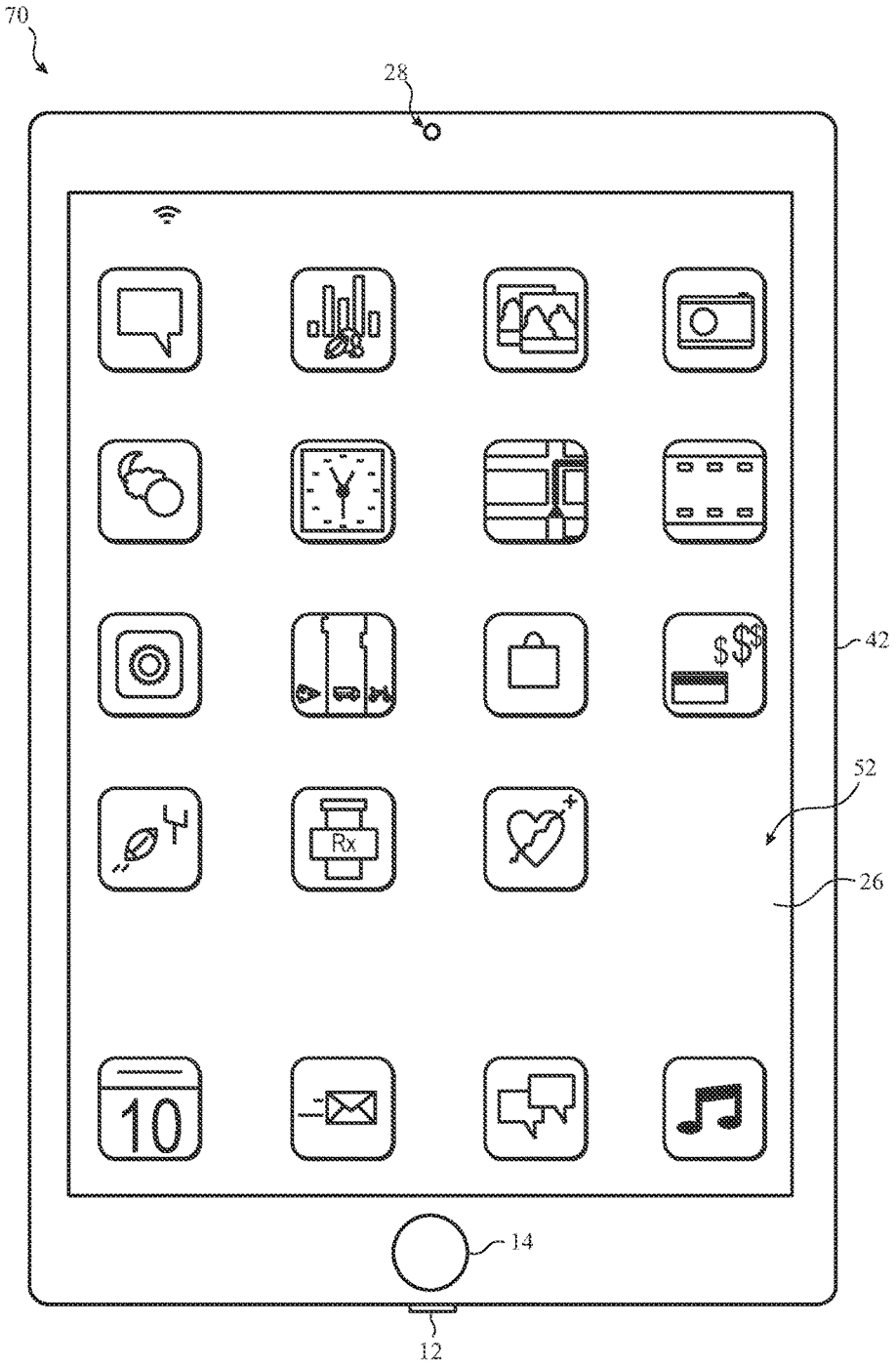
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
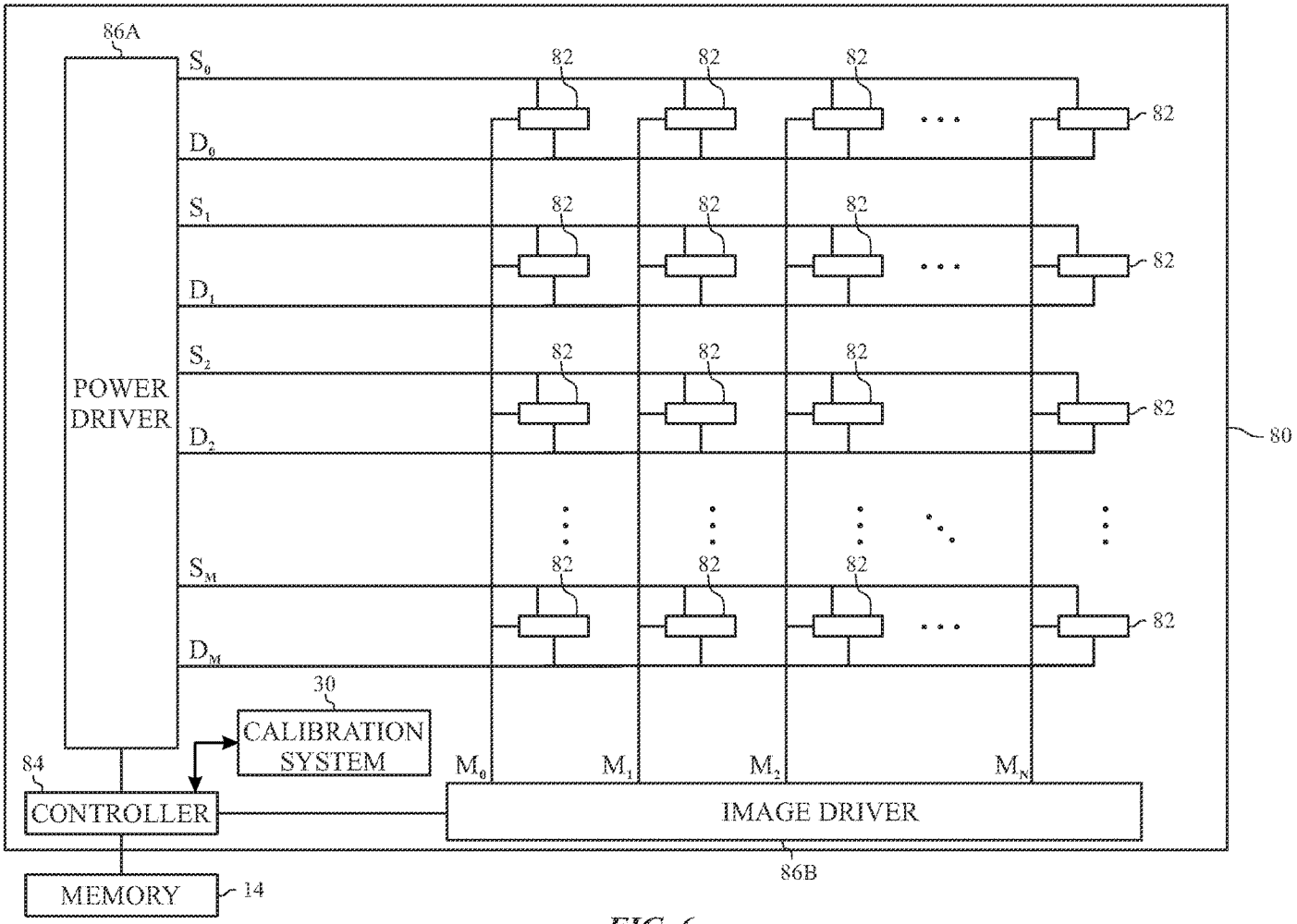
FIG. 6 is a circuit diagram of an array of self-emissive pixels of the electronic display of the electronic device of FIG. 1, in accordance with aspects of the present disclosure.

Having provided some context with regard to possible forms that the electronic device 10 may take, the present discussion will now focus on the calibration system 30 of FIG. 1. Generally, the brightness depicted by each respective pixel in the display 26 is generally controlled by varying an electric field associated with each respective pixel in the display 26. Keeping this in mind, FIG. 6 illustrates one embodiment of a circuit diagram of display 26 that may generate the electrical field that energizes each respective pixel and causes each respective pixel to emit light at an intensity corresponding to an applied voltage. As shown, display 26 may include a self-emissive pixel array 80 having an array of self-emissive pixels 82.

The self-emissive pixel array 80 is shown having a controller 84, a power driver 86A, an image driver 86B, and the array of self-emissive pixels 82. The self-emissive pixels 82 are driven by the power driver 86A and image driver 86B. Each power driver 86A and image driver 86B may drive one or more self-emissive pixels 82. In some embodiments, the power driver 86A and the image driver 86B may include multiple channels for independently driving multiple self-emissive pixels 82. The self-emissive pixels may include any suitable light-emitting elements, such as organic light emitting diodes (OLEDs), micro-light-emitting-diodes (μ-LEDs), and so forth.

The power driver 86A may be connected to the self-emissive pixels 82 by way of scan lines $S_0$, $S_1$, . . . $S_{m-1}$, and $S_m$ and driving lines $D_0$, $D_1$, . . . $D_{m-1}$, and $D_m$. The self-emissive pixels 82 receive on/off instructions through the scan lines $S_0$, $S_1$, . . . $S_{m-1}$, and $S_m$ and generate driving currents corresponding to data voltages transmitted from the driving lines $D_0$, $D_1$, . . . $D_{m-1}$, and $D_m$. The driving currents are applied to each self-emissive pixel 82 to emit light according to instructions from the image driver 86B through driving lines $M_0$, $M_1$, . . . $M_{n-1}$, and $M_n$. Both the power driver 86A and the image driver 86B transmit voltage signals through respective driving lines to operate each self-emissive pixel 82 at a state determined by the controller 84 to emit light. Each driver may supply voltage signals at a duty cycle and/or amplitude sufficient to operate each self-emissive pixel 82.

The controller 84 may control the color of the self-emissive pixels 82 using image data generated by the processor(s) 16 and stored into the memory 18 or provided directly from the processor(s) 16 to the controller 84. The controller 84 may also provide a signal to the calibration system 30 to filter noise from voltage signals provided to each self-emissive pixel 82 in accordance with the techniques that will be described in detail below.

Figure 7:
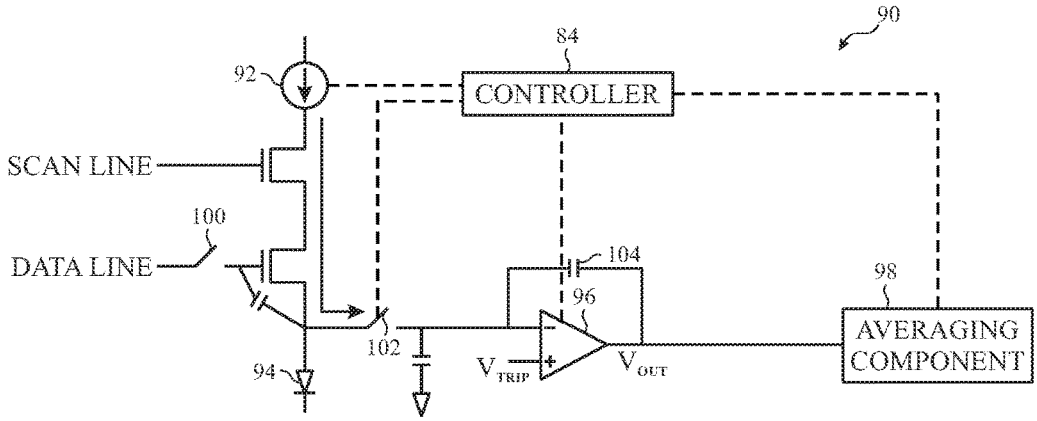
FIG. 7 is a circuit diagram of a calibration system that averages voltage samples provided to a pixel in the electronic device of FIG. 1, in accordance with aspects of the present disclosure.

With the foregoing in mind, FIG. 7 illustrates one embodiment of the calibration system 30 that averages voltage samples provided to a self-emissive. Referring now to the circuit 90 of the calibration system 30 in FIG. 7, the circuit 90 may include a current source 92, a pixel 94 (e.g., OLED), a comparator component 96, an averaging component 98, a first switch 100, and a second switch 102. In operation, the current source 92 may provide a constant current I to the comparator component 96 via the switch 102. The current I may then charge a capacitor 104 across the comparator component 96. As a result, the voltage received by the comparator component 96 may change as the capacitor 104 charges.

Figure 8:
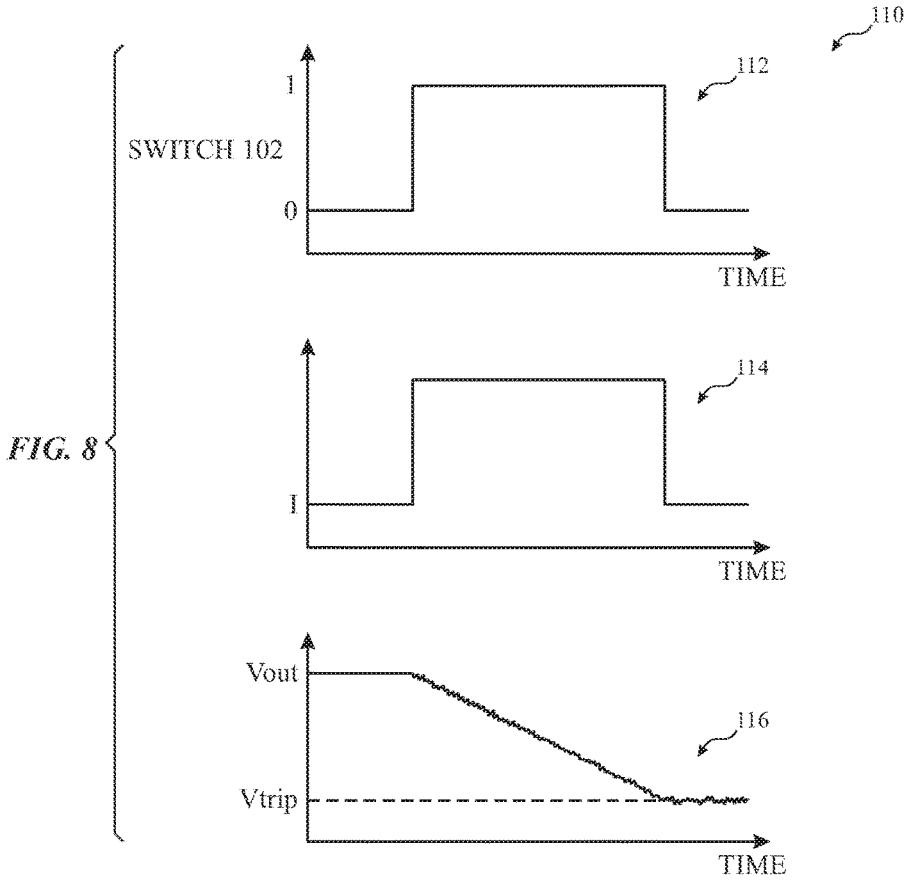
FIG. 8 is a collection of waveforms related to the operation of the calibration system of FIG. 7, in accordance with aspects of the present disclosure.

For example, FIG. 8 includes a collection of waveforms 110 that correspond to the operation of the circuit 90. Waveform 112 illustrates the operational state of the switch 102 (e.g., opened or closed). Waveform 114 illustrates the current I received by the comparator component 96, and waveform 116 illustrates the voltage output by the comparator component 96.

As shown in FIG. 8, the voltage received by the comparator component 96, in one example, may linearly decrease when the current I is received by the comparator component 96. The comparator component 96 may continuously compare the input voltage signal to a threshold voltage (Vtrip) and may cause the switch 102 to open when the input voltage signal reaches the threshold voltage. When the switch 102 opens, the voltage output by the comparator component 96 may remain constant at the threshold voltage (Vtrip). However, due to noise that may be present on the input voltage signal, the voltage output by the comparator component 96 may fluctuate as shown in the voltage waveform 116. To filter the noise component from the voltage signal, the averaging component may obtain multiple samples of the voltage output by the comparator component 96 after the threshold voltage (Vtrip) has been reached. The averaging component 98 may then determine an average value of the multiple samples acquired after the threshold voltage (Vtrip) has been reached.

Figure 9:
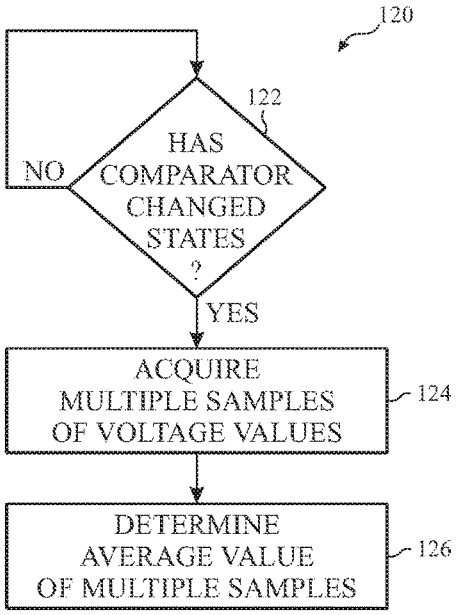
FIG. 9 is a flow chart of a method for filtering noise present in a voltage signal provided to a pixel using the calibration system of FIG. 7, in accordance with aspects of the present disclosure.

With the foregoing in mind, FIG. 9 illustrates a method 120 for filtering noise in the voltage signal provided to the pixel 94 based on an average of voltage samples. Although the following description of the method 120 is described as being performed by the averaging component 98, it should be noted that any suitable component having a processor may be capable of performing the method 120.

Referring now to FIG. 9, at block 122, the averaging component 98 may determine whether the comparator component 96 has changed states. If the comparator component 96 does not change states, the averaging component 98 may return to block 122 and continue monitoring the status of the comparator component 96. If the comparator component 96 changes states, the averaging component 98 may receive a signal from the comparator component 96 indicating such.

After determining that the comparator component 96 changed states, the averaging component 98 may proceed to block 124. At block 124, the averaging component 98 may acquire multiple samples of the voltage signal output by the comparator component 96. As discussed above, the voltage output by the comparator component 96 after the comparator component 96 changes states may fluctuate due to the noise component present on the voltage signal. At block 126, the averaging component 98 may determine an average value of the sample voltage measurements acquired at block 124. The average value of the sample voltage measurements may filter at least a portion of the noise component from the voltage signal. The processor 16 or another suitable component may then use the average voltage value to calibrate the pixel 94.

Figure 10:
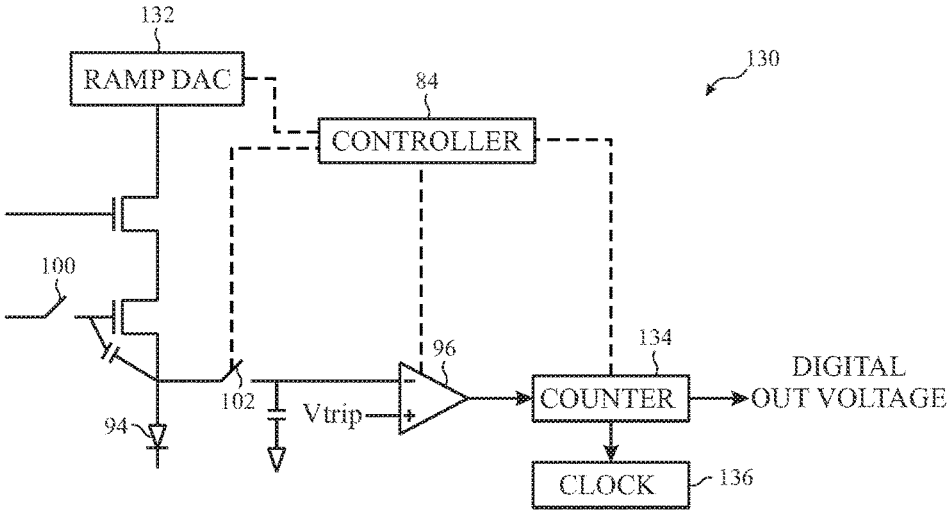
FIG. 10 is a circuit diagram of a calibration system that employs a ramp digital-to-analog converter (DAC) voltage signal to calibrate a voltage provided to a pixel of the display in the electronic device of FIG. 1, in accordance with aspects of the present disclosure.
Figure 11:
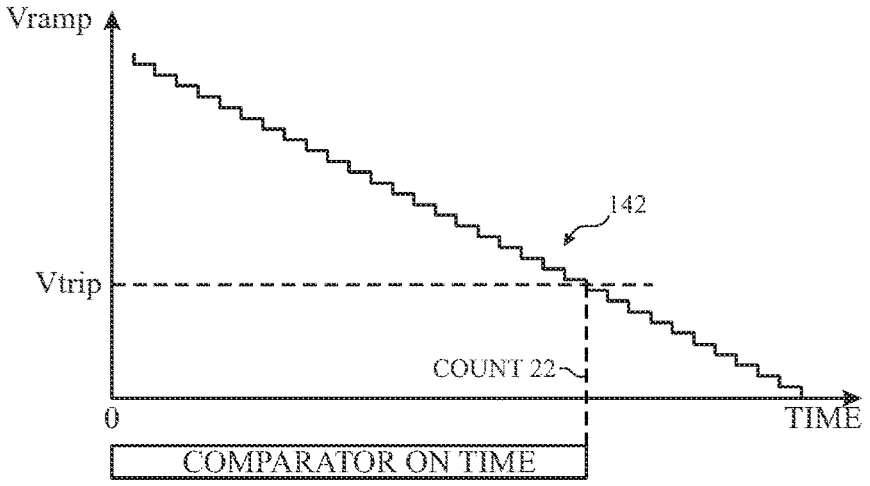
FIG. 11 is an illustration of the ramp DAC voltage signal that may be used in the calibration system of FIG. 10, in accordance with aspects of the present disclosure.

In addition to the circuit 90 described above, FIG. 10 illustrates a circuit 130 of another embodiment of the calibration system 30 that employs a ramp digital-to-analog converter (DAC) voltage signal to calibrate a voltage provided to the pixel 94. In one embodiment, the circuit 130 may include a ramp DAC voltage source 132 that may output a ramp DAC voltage signal. The ramp DAC voltage signal may correspond to a voltage signal that steps up or steps down at an incremental voltage value. For instance, FIG. 11 illustrates an example ramp DAC voltage signal 142 that decreases at an incremental voltage value.

Referring back to FIG. 10, each voltage step of the ramp DAC voltage signal 142 may correspond to a count measured by a counter component 134. The counter component 134 may be associated with a clock component 136 that may be synchronized with the counter component 134.

In operation, the comparator component 96 may receive the ramp DAC voltage signal via the switch 102 and compare the ramp DAC voltage signal to a threshold voltage (Vtrip). When the ramp DAC voltage signal reaches the threshold voltage (Vtrip), the comparator component 96 may change states. After the comparator component 96 changes states, the count value according to the counter component 134 that corresponds to when the comparator component 96 changed states may be used to determine a precise voltage value of the ramp DAC voltage signal that corresponds to the threshold voltage. For instance, as shown in FIG. 11, the ramp DAC voltage signal 142 may decrease 22 times before the ramp DAC voltage signal 142 reaches the threshold voltage Vtrip. Using the count value (22), the processor 16 or other suitable component may determine the voltage value of the ramp DAC voltage signal at count 22 since the ramp DAC voltage signal is known.

Figure 12:
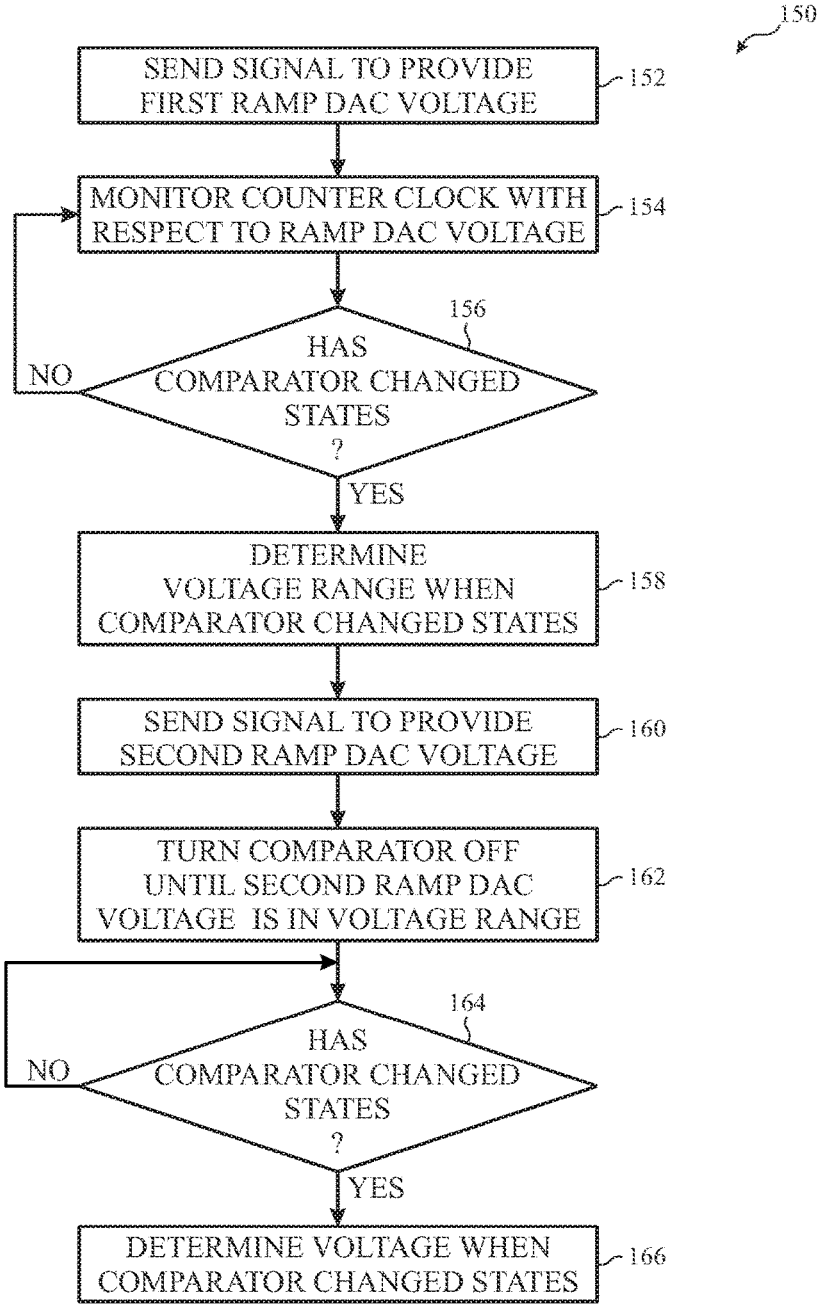
FIG. 12 is a flow chart of a method for calibrating a pixel using the calibration system of FIG. 10, in accordance with aspects of the present disclosure.

Although the above description for determining the voltage value that corresponds to the threshold voltage (Vtrip) may assist in calibrating the pixel 94, the comparator component 96 continuously monitors the ramp DAC voltage signal 142 until it reaches the threshold voltage (Vtrip). This continuous monitoring of the ramp DAC voltage signal 142 consumes a large portion of the energy in the circuit 130. With this in mind, FIG. 12 illustrates a method 150 for calibrating the pixel 94 using the ramp DAC voltage signal 142 while enabling the comparator component 96 to monitor the ramp DAC voltage signal 142 less frequently. For the purposes of discussion, the following description of the method 150 is described as being performed by the controller 84, but it should be understood that any suitable controller or processor may perform the method 150.

Referring now to FIG. 12, at block 152, the controller 84 may send a signal to the ramp DAC voltage source 132 to provide a first ramp DAC voltage signal. At block 154, the controller 84 may monitor the counter component 134 with respect to the first ramp DAC voltage signal. At block 156, the controller 84 may determine whether the comparator component 96 changed states. If the comparator component 96 did not change states, the controller 84 may return to block 154 and continue to monitor the counter component 134. In one embodiment, during the operation of blocks 154 and 156, the comparator component 96 remains active as it monitors the first ramp DAC voltage signal with respect to the threshold voltage (Vtrip) until it changes states at which it may turn off.

If the controller 84 determines that the comparator component 96 has changed states (e.g., by receiving an indication from the comparator component 96), the controller 84 may proceed to block 158 and determine a voltage range in which the comparator component 96 changed states. With this in mind, at block 160, the controller 84 may send another signal to the ramp DAC voltage source 132 to provide a second ramp DAC voltage signal to the comparator component 96. The second ramp DAC voltage signal may include smaller voltage increments as compared to the first ramp DAC voltage signal. As such, the first ramp DAC voltage signal may employ relatively large voltage increments at each voltage step to determine a range of voltages that include the particular voltage value that causes the comparator component 96 to change states.

Using the voltage range determined at block 158, the controller 84 may, at block 162, activate the comparator component 96 for counts that correspond to when the second ramp DAC voltage signal is within the determined range. As such, the comparator component 96 may be active for a portion of the time in which the second ramp DAC voltage signal is provided to the comparator component 96.

At block 164, the controller 84 may determine whether the comparator component 96 has changed states. If the comparator component 96 has not changed states, the controller 84 may return to block 164 and continue monitoring the status of the comparator component 96. If, however, the comparator component 96 does change states, the controller 84 may proceed to block 166 and determine a voltage that corresponds to the count at which the comparator component 96 changed states. That is, the controller 84 may use the count that corresponds to when the comparator component 96 changes states to determine a voltage value of the second ramp DAC voltage signal that corresponds to the threshold voltage (Vtrip).

Figure 13:
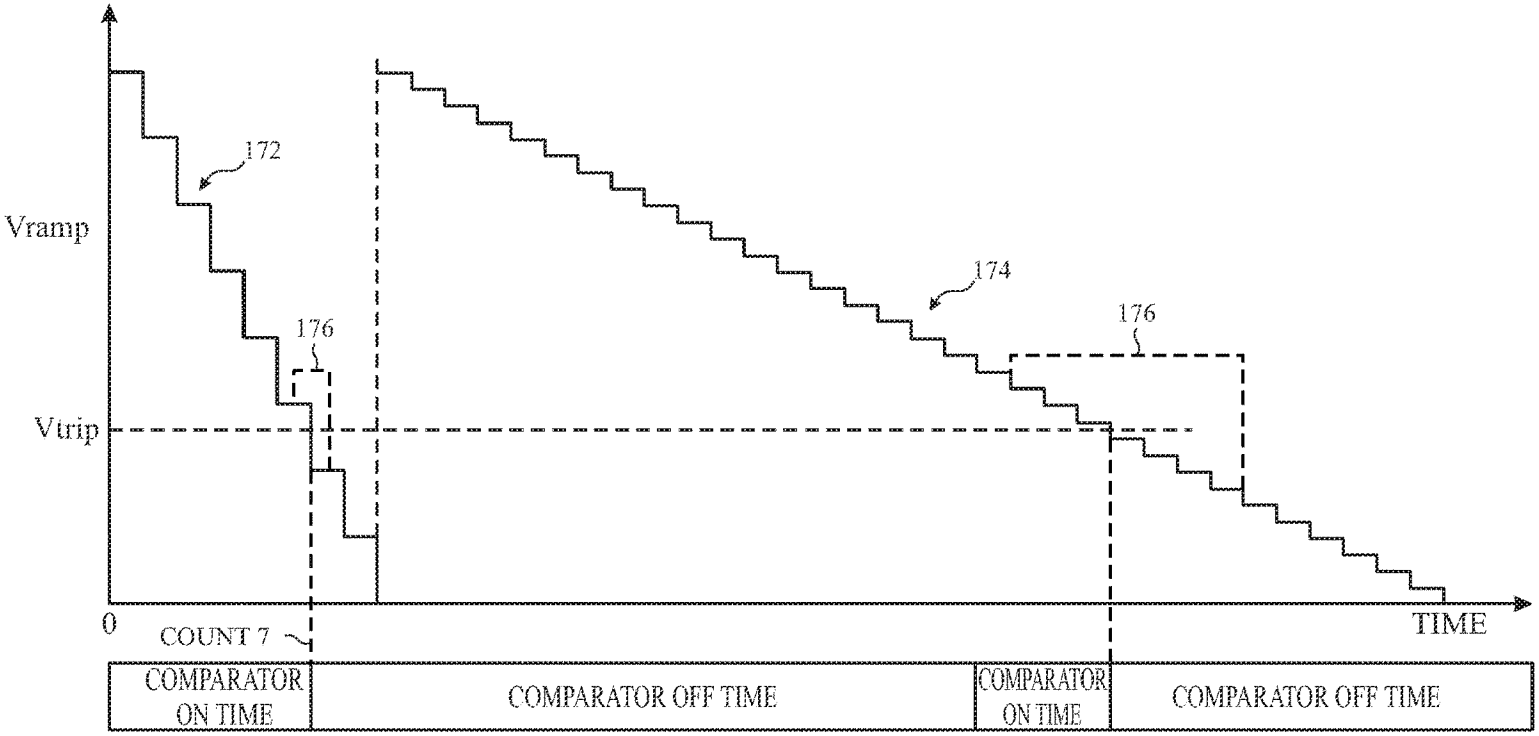
FIG. 13 is an illustration of two ramp DAC voltage signals that may be used in the calibration system of FIG. 10, in accordance with aspects of the present disclosure.

By employing the method 150 described above, the comparator component 96 may be active for less time as compared to using a single ramp DAC voltage signal. To better illustrate the power savings of the comparator component 96 by employing the method 150*m* FIG. 13 illustrates example waveforms of the first and second ramp DAC voltage signals described above. As shown in FIG. 13, a first ramp DAC voltage signal 172 may include larger voltage steps as compared to a second ramp DAC voltage signal 174. When employing the method 150, the controller 84 may identify a voltage step in the first ramp DAC voltage signal 172 that corresponds to when the comparator component 96 changes states (e.g., at count 7). The identified voltage step may correspond to a voltage range 176 that corresponds to when the comparator component 96 changes states. Using the voltage range 176 associated with the transition between count 6 and count 7, the controller 84 may activate the comparator component 96 during the same voltage range 176 when the second ramp DAC voltage signal 174 is provided to the comparator component 96. As a result, the comparator component 96 may be not be active for the entire duration of the second ramp DAC voltage signal 174, which may be used to identify a precise voltage value received by the pixel 94 that corresponds to the threshold voltage (Vtrip).

Figure 14:
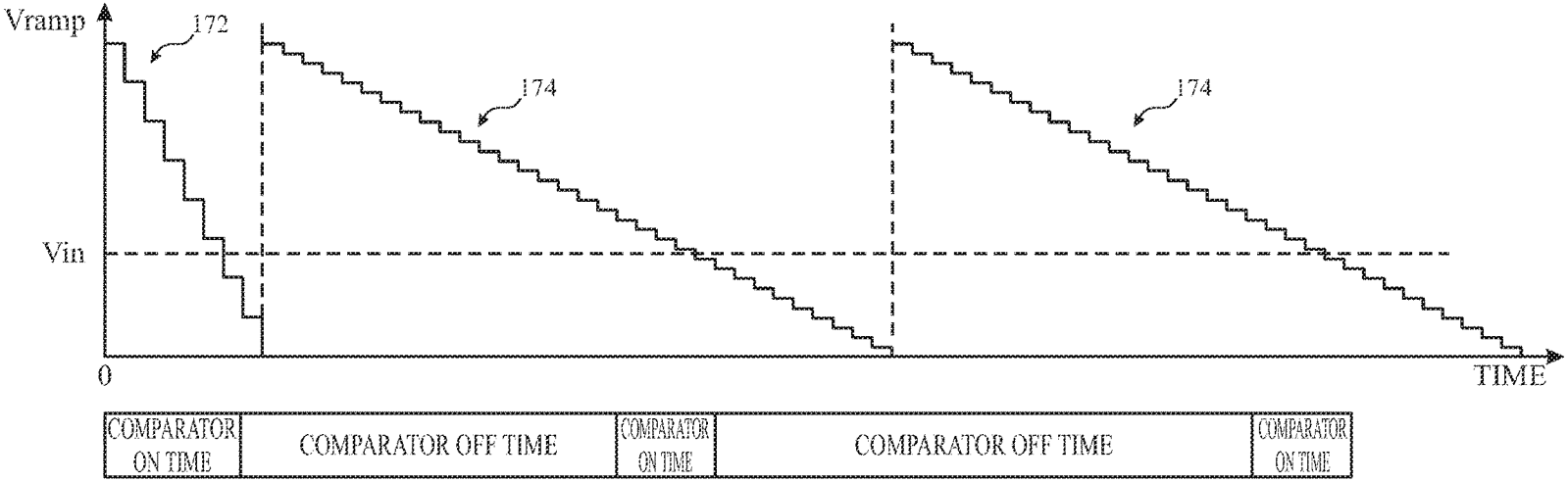
FIG. 14 is an illustration of three ramp DAC voltage signals that may be used in the calibration system of FIG. 10, in accordance with aspects of the present disclosure.

Keeping the method 150 in mind, the controller 84 may, in some embodiments, send a command to the ramp DAC voltage source 132 to provide the second ramp DAC voltage signal 174 again as illustrated in FIG. 14. In one embodiment, the controller 84 may reduce the voltage range in which the comparator component 96 is active when the second ramp DAC voltage signal 174 is received again to further fine tune the voltage value that corresponds to the threshold voltage (Vtrip). In the same manner, the controller 84 may also send a command to the ramp DAC voltage source 132 to provide a third DAC ramp voltage signal that includes smaller voltage steps as compared to the second ramp DAC voltage signal 174. As such, the controller 48 may identify a more precise value of the voltage that corresponds to the threshold voltage (Vtrip).

Figure 15:
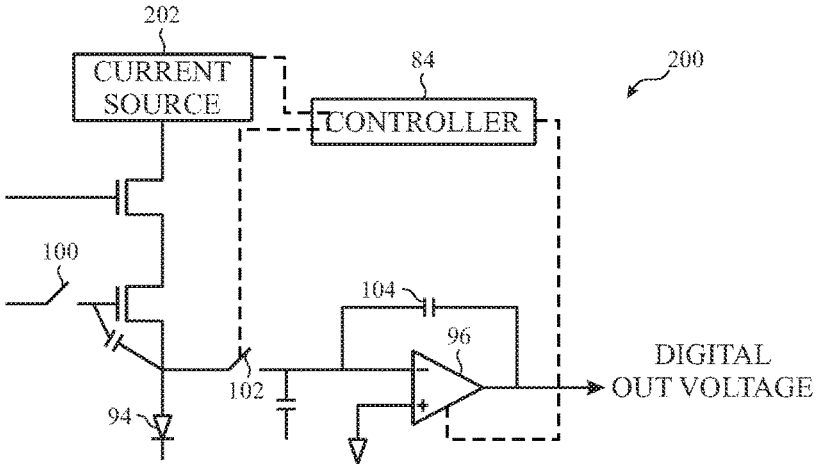
FIG. 15 is a circuit diagram of a calibration system that employs a time-to-digital converter (TDC) voltage signal to calibrate a voltage provided to a pixel of the display in the electronic device of FIG. 1, in accordance with aspects of the present disclosure.

In addition to using a ramp DAC voltage signal as described above with regard to FIGS. 10-14, in some embodiments, the calibration system 30 may employ a time-to-digital converter (TDC) approach to calibrating a voltage value provided to the pixel 94. For example, FIG. 15 illustrates a circuit 200 that may be employed by the calibration system 30 to calibrate the pixel 94. The circuit 200 may include the pixel 94, the comparator component 96, and the capacitor 104 described above. Additionally, the circuit 200 may include a current source 202 that may provide a constant current I to the pixel 94 and to the capacitor 104. As discussed above with regard to FIG. 7, when the switch 102 closes, the voltage across the capacitor 104 may change accordingly. In certain embodiments, the controller 84 or any other suitable component may set a first threshold voltage for the comparator component 96 based on an expected ramp voltage signal received at the comparator component 96 when the capacitor 104 is being charged. That is, since the current I and the capacitance value of the capacitor 104 is known, the controller 84 may determine the voltage at the comparator component 96 at various times. In other words, the controller 84 may determine the voltage ramp function of the voltage received or the slope of the voltage signal received at the comparator component 96 with respect to time based on the known current I and the capacitance of the capacitor 104.

Figure 16:
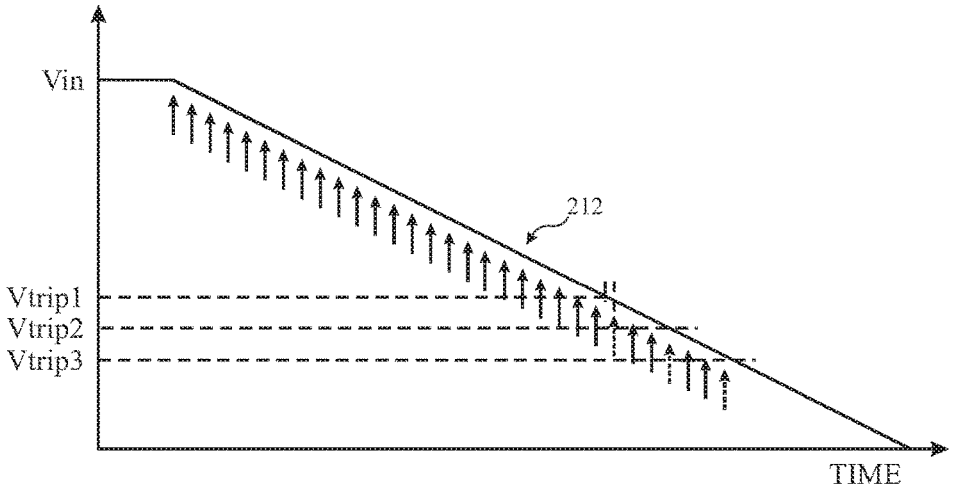
FIG. 16 is an illustration of the TDC voltage signal that may be used in the calibration system of FIG. 15, in accordance with aspects of the present disclosure.

With this in mind, FIG. 16 illustrates an example voltage waveform 212 input at the comparator component 96 of the circuit 200. In certain embodiments, the controller 84 may use multiple threshold voltages (e.g., Vtrip1, Vtrip2, Vtrip3) at the comparator component 96 to calibrate the pixel 94. For example, FIG. 17 illustrates a method 220 that may be employed by the controller 84 or any other suitable device to calibrate the pixel 94 based on the TDC approach.

Figure 17:
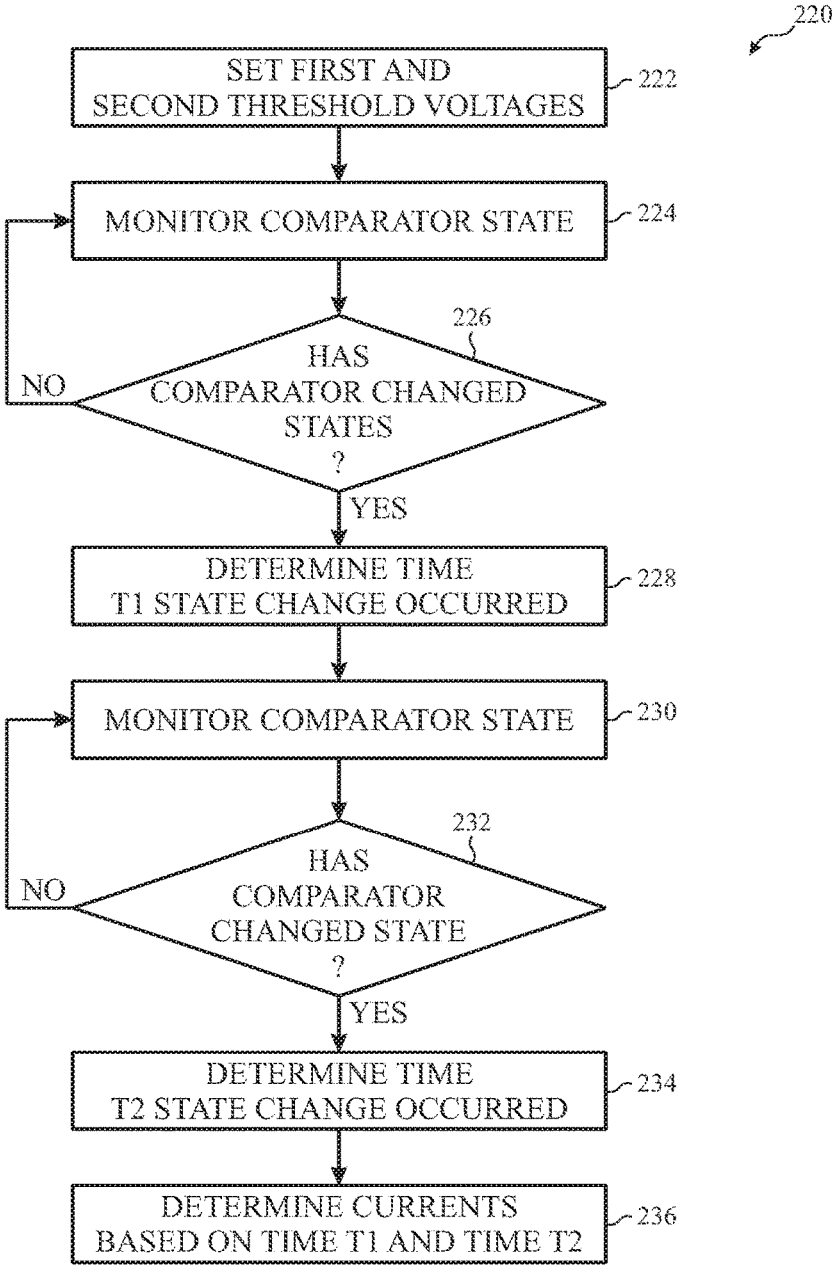
FIG. 17 is a flow chart of a method for calibrating a pixel using the calibration system of FIG. 15, in accordance with aspects of the present disclosure.

Referring to FIG. 17, at block 222, the controller 84 may set a first threshold voltage (Vtrip1) and a second threshold (Vtrip2) for the comparator component 96. As such, the controller 84 may send the first threshold voltage (Vtrip1) and the second threshold (Vtrip2) to the comparator component 96, and the comparator component 96 may begin monitoring the voltage input. In one embodiment, the controller 84 may determine the threshold voltages based on the current I provided to the comparator component 96 and the capacitance of the capacitor 104. That is, using the current I provided to the comparator component 96 and the capacitance of the capacitor 104, the controller 84 may determine the slope of the voltage signal input to the comparator component 96. Based on the slope, the controller 84 may identify the first threshold voltage (Vtrip1) and the second threshold (Vtrip2) long the voltage signal waveform.

At block 224, the controller 84 may monitor the state of the comparator component 96. The controller 84 may then determine whether the comparator component 96 has changed states at block 226. If the comparator component 96 has not changed states, the controller 84 may return to block 224. If, however, the comparator component 96 changes states, the controller 84 may proceed to block 228 and determine a time T1 at which the state change occurred.

At block 230, the controller 84 may again monitor the state of the comparator component 96, which may have reset after changing states at block 226. At block 232, the controller 84 may determine whether the comparator component 96 has changes states again (e.g., at the second threshold voltage (Vtrip2)). If the comparator component 96 has not changed states, the controller 84 may return to block 230 and continue monitoring the state of the comparator component 96. If the comparator component 96 changes states at block 232, the controller 84 may proceed to block 234 and determine a time T2 that the comparator component 96 changed states.

After determining the times T1 and T2 that the state changes occurred, the controller 84 may proceed to block 236 and determine current values that correspond to the times T1 and T2. That is, the controller 84 may use the time T1 to determine a first current I1 provided to the comparator component 96 that corresponds to the first threshold voltage (Vtrip1). Since the comparator component 96 switched states at time T1 when the voltage at the comparator component 96 reached the first threshold voltage (Vtrip1), the controller 84 may determine the first current I1 based on the first threshold voltage (Vtrip1), the capacitance (C) of the capacitor 104, and the time T1 according to Equation 1 below:

$$I1=(C*V\text{trip}1)/T1 \quad (1)$$

In the same manner, the controller 84 may determine the second current I2 based on the second threshold voltage (Vtrip2), the capacitance (C) of the capacitor 104, and the time T2 according to Equation 2 below:

$$I2=(C*V\text{trip}2)/T2 \quad (2)$$

It should be noted that although the method 220 is described as being performed for two threshold voltages, the method 220 may be performed for a number of threshold voltages.

Since the current source 202 provides a constant current I to the comparator component 96, the first current I1 and the second current I2 should match the constant current I output by the current source 202. However, due to noise being present within the display 26, the first current I1 and the second current I2 may be different from each other. As such, the controller 84 may determine an average value of the first current I1 and the second current I2 to filter at least a portion of the noise. The controller 84 or another suitable component may then calibrate the pixel 94 based on the average current.

As discussed above, the comparator component 96 consumes energy when it monitors the input voltage with regard to the threshold voltage. As such, in some embodiments, when monitoring the state of the comparator component 96 at blocks 224 and 230, the controller 84 may send signals to the comparator component 96 to activate for periods of time in which the times at which the comparator component 96 is expected to change states. In this way, the comparator component 96 may not be active for the entire duration of the input voltage waveform. Instead, the comparator component 96 may be active for just portions of time when it receives the input voltage.

Figure 18:
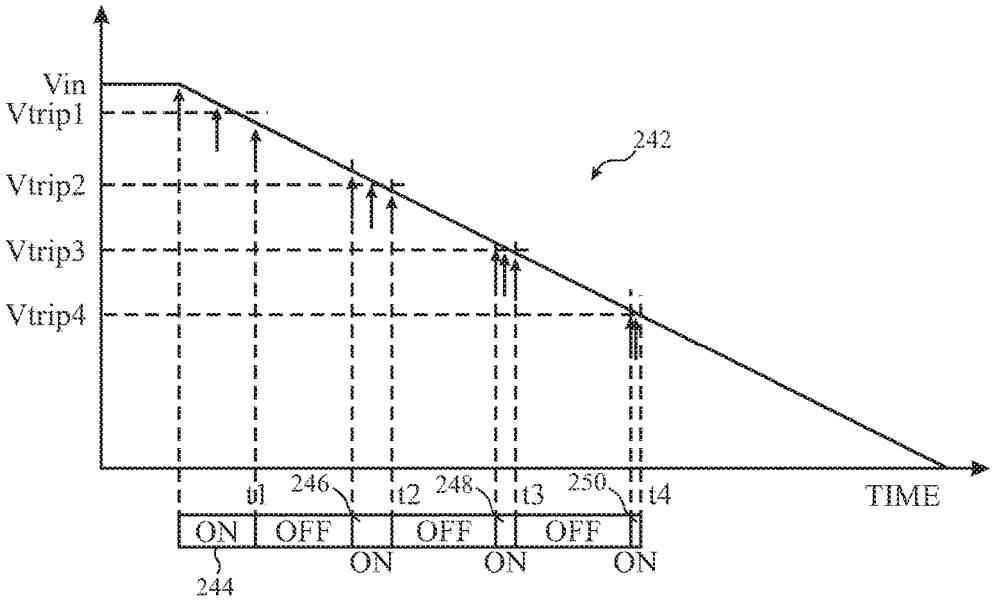
FIG. 18 is an illustration of the TDC voltage signal that may be used in the calibration system of FIG. 15 and sampling periods associated with the calibration system, in accordance with aspects of the present disclosure.

For instance, FIG. 18 illustrates a sample voltage input signal 242 received at the comparator component 96 and time periods 244, 246, 248, 250 that corresponds to a range of time values in which the threshold voltages are expected to occur. With this in mind, the controller 84 may perform the method 220 described above while activating the comparator component 96 for a significantly less amount of time as compared to for the duration of the voltage signal 242.

In addition to the time duration that the comparator component 96 is active, the amount of energy consumed by the comparator component 96 is proportional to the clock speed in which the comparator component 96 samples the voltage signal 242. As such, in some embodiments, the controller 84 may cause the comparator component 96 to use change its clock speed during different time periods when a threshold voltage is expected to occur.

Figure 19:
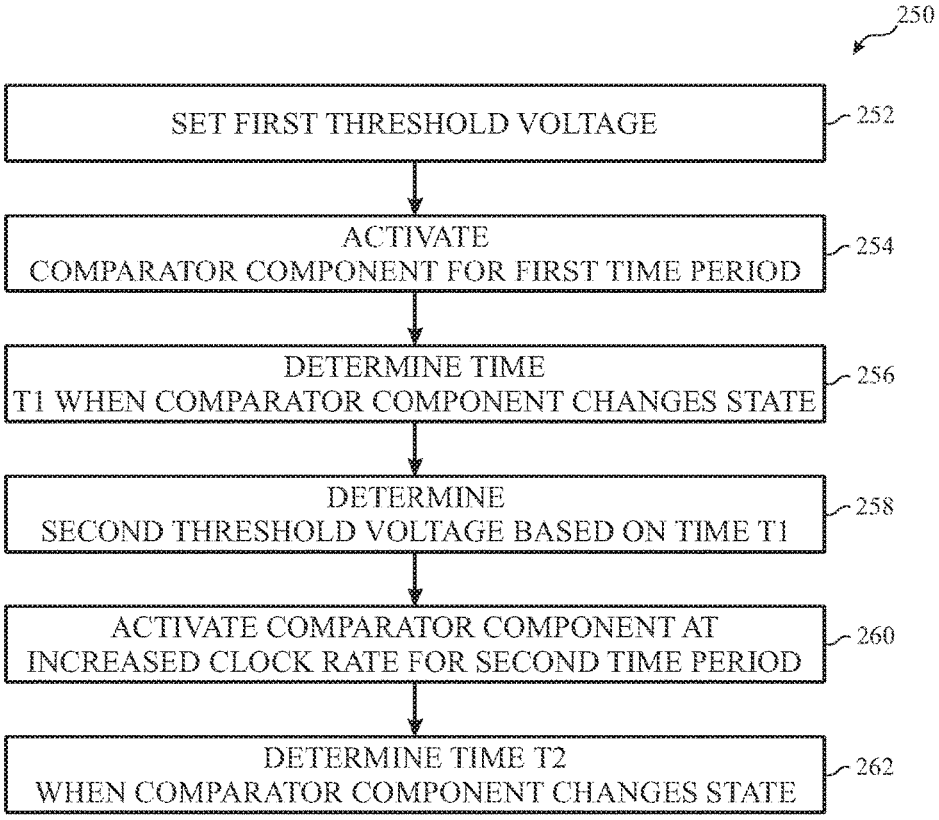
FIG. 19 is a flow chart of a method for calibrating a pixel using the calibration system of FIG. 15, in accordance with aspects of the present disclosure.

With this in mind, FIG. 19 illustrates a method 250 that may be employed by the controller 84 or any other suitable device to calibrate the pixel 94 based on the TDC approach, variable time periods, and variable sampling rates. Like the methods discussed above, the method 250 may be performed by the controller 84 or any other suitable processing devices.

Referring to FIG. 19, at block 252, the controller 84 may set the first threshold voltage as described above with respect to block 222 of the method 220. At block 254, the controller 84 may activate the comparator component 96 for a first time period at a first sampling rate.

During the first time period, the comparator component 96 may monitor the input voltage at the first sampling rate. When the comparator component 96 changes states, at block 256, the controller 84 may determine the time T1 at which the comparator component 96 changes states. At block 258, the controller 84 may determine a second threshold voltage (Vtrip2) based on the slope of the voltage input. That is, the controller 84 may determine the second threshold voltage (Vtrip2) based on a calculated current I1, as determined based on the time T1, the capacitance of the capacitor 104, and the first threshold voltage (Vtrip1).

Since the current I1 is determined based on the time T1 that the comparator component 96 changes states, the current I1 may be used to determine a more accurate slope of the voltage input to the comparator component 96. As such, at block 260, the controller 84 may activate the comparator component 96 during a second period of time in which the second threshold voltage (Vtrip2) is expected. With the increased accuracy of the slope, the second period of time may be shorter than the first period of time. Additionally, in some embodiments, the controller 84, at block 260, may increase the sampling rate at which the comparator component 96 may sample the voltage input signal during the second period of time.

At block 262, the controller 84 may determine the time T2 when the comparator component 96 changes states due to the voltage input signal reaching the second threshold voltage (Vtrip2). In some embodiments, the controller 84 may repeat blocks 258-262 a number of times. As such, each subsequent time period may be shorter than the previous time period and the sampling rate of the comparator component 96 may continue to increase. As a result, the controller 84 may obtain a number of times, such that a number of current values may be determined and averaged to filter noise from the input current. Using the average current value, the controller 84 may then calibrate the pixel 94.

Figure 20:
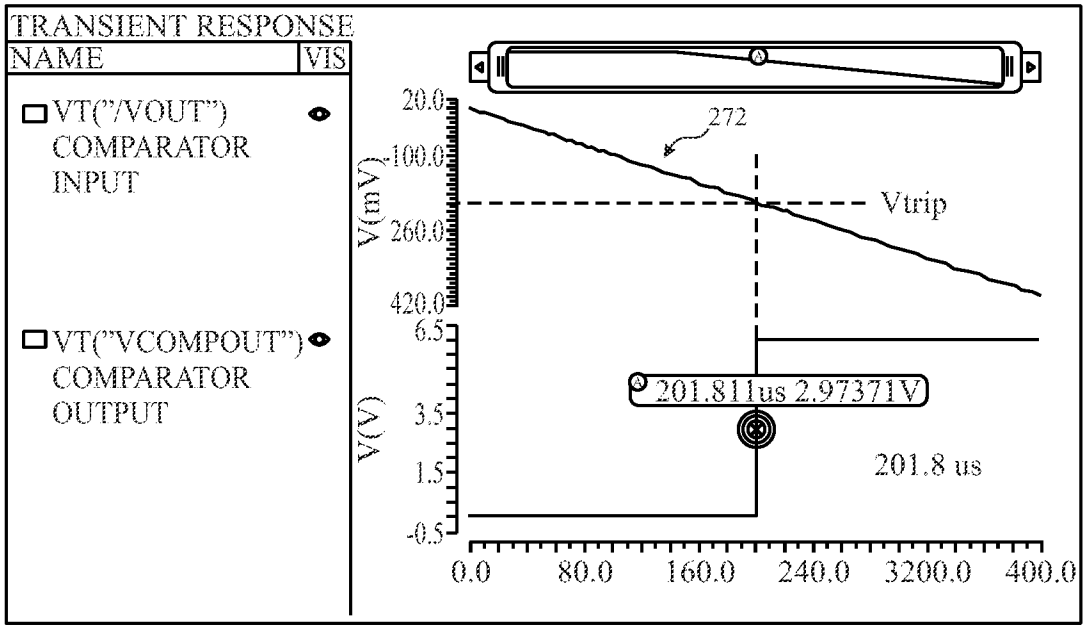
FIG. 20 is an illustration of an expected TDC voltage signal that may be received by a calibration system and an expected voltage output by the calibration system, in accordance with aspects of the present disclosure.

Although the methods described above may improve the signal-to-noise ratio of the voltage and current that correspond to a threshold voltage of the comparator component 96, additional techniques may be employed to filter more of the noise component present on the voltage and current. With this in mind, an expected voltage signal without noise present in the signal is depicted in FIG. 20. As shown in the example of FIG. 20, if an input voltage signal 272 at the comparator component 96 of the circuit 200 contains no noise, the comparator component 96 may switch states at 201.811 μs when the voltage signal 272 reaches the threshold voltage. However, when noise is present on the voltage signal 272, the comparator component 96 may not switch states at the same time as expected when noise is present on the voltage signal 272.

Figure 21:
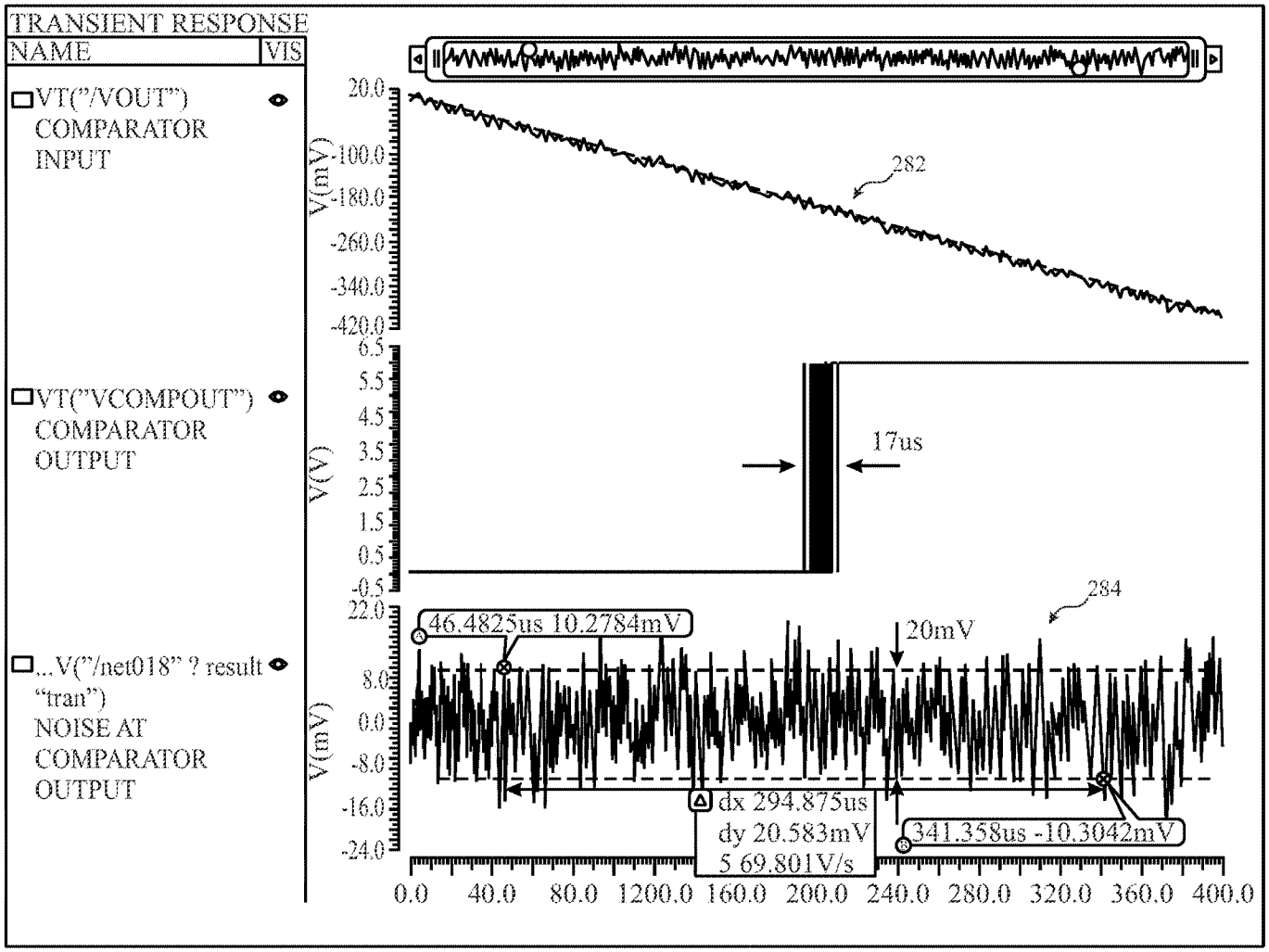
FIG. 21 is an illustration of a noisy TDC voltage signal that may be received by a calibration system and an illustration of the voltage outputs by the calibration system within a time period that corresponds to a threshold voltage of a comparator component in the calibration system, in accordance with aspects of the present disclosure.

FIG. 21 depicts a voltage signal 282 that includes noise. As shown in the voltage signal 282, the voltage of the voltage signal 282 does not follow a straight linear path. Instead, the voltage signal 282 fluctuates along the linear path. In some embodiments, the comparator component 96 may change states each time the voltage signal 282 crosses the threshold voltage in either magnitude (e.g., +/−). As such, the controller 84 may monitor the fluctuations of the voltage signal 282 from when the comparator component 96 first crosses the threshold voltage until when the comparator component 96 crosses the threshold voltage for the last time.

Figure 23:
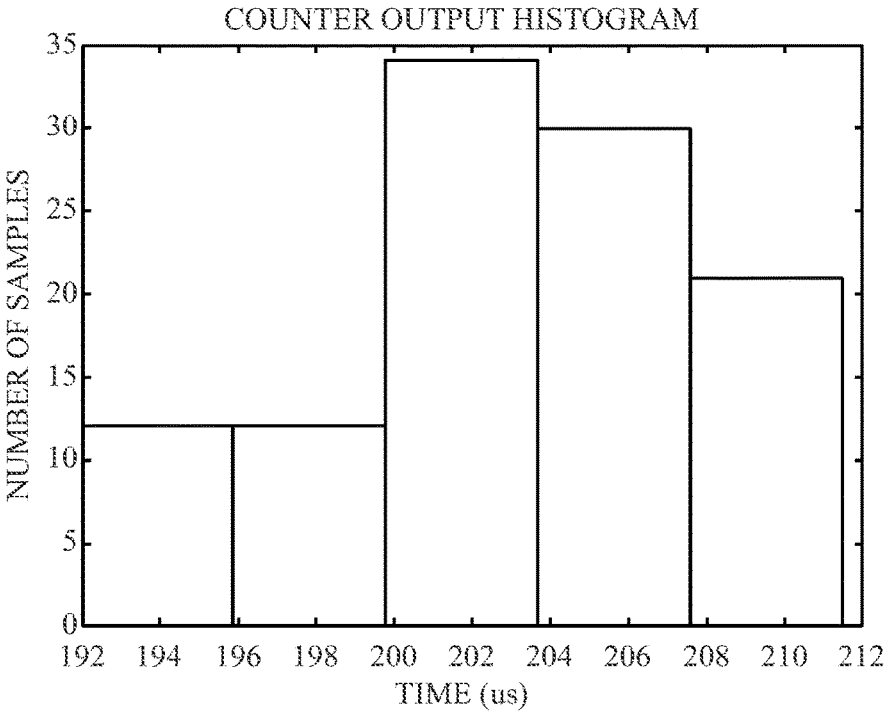
FIG. 23 is an illustration of a sample Gaussian distribution of clock counts that correspond to when the comparator component of the calibration system to change states within a time period that corresponds to a threshold voltage of a comparator component, in accordance with aspects of the present disclosure.

The fluctuations of the voltage signal 282, for example, is depicted in FIG. 21 as waveform 284. That is, the comparator component 96 that receives the voltage signal 282 may change states continuously within a 17 μs period of time due to the noise present on the voltage signal 282. FIG. 23 describes a method 290 that the controller 84 or another suitable processor component may perform to filter noise present in a voltage signal provided to a comparator component of the calibration system 30. For discussion purposes, the following description of the method 290 will be discussed with reference to the circuit 200 of FIG. 15, however, it should be noted that the method 290 may be performed with the other techniques described within this disclosure.

Figure 22:
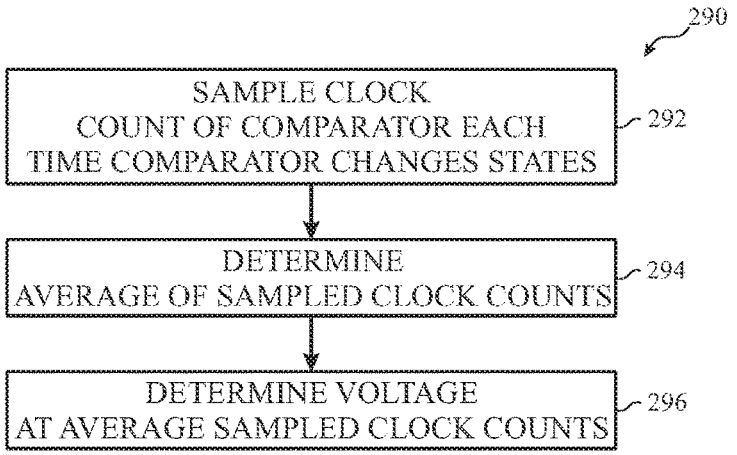
FIG. 22 is a flow chart of a method for filtering noise of a voltage signal provided to a pixel based on clock counts in which the voltage signal caused a comparator component of the calibration system to change states, in accordance with aspects of the present disclosure.

Referring to FIG. 22, at block 292, the controller 84 may sample the clock count or time of the comparator component 96 each time the comparator component 96 changes states. As discussed above, in some embodiment, the comparator component 96 may change states each time the voltage signal 282, for example, crosses the threshold voltage. As such, the controller 84 may record a time value each time the comparator component 96 changed states.

At block 294, the controller 84 may determine an average time value of the time values collected at block 292. It should be noted that the distribution of the times at which the comparator component 96 changes states may generally follow a Gaussian trend. For instance, FIG. 23 illustrates a histogram of the number of samples that correspond to when the comparator changes states with respect to time. As seen in FIG. 23, the distribution of the number of samples follow a Gaussian trend in that the largest number of samples occur near the middle of the time ranges. As such, the average time value may provide a better approximation of the time in which the comparator component 96 would have changed states if no noise was present on the voltage signal 282. For instance, referring back to the voltage signal 272 of FIG. 20 that does not include a noise component, the time at which the comparator component 96 changed states was recorded as 201.811 μs. Now referring to the voltage signal 282 that includes noise, the average time value of the samples collected at block 292 may be 203.4 μs, which is within 1.6 μs of the expected 201.811 μs time recorded for the voltage signal 272. As such, the error between the averaged time values and the expected value is approximately 1%. Thus, the average time values may effectively filter a large portion of the noise present on the voltage signal 282.

After determining the average time value, at block 296, the controller 84 may determine the voltage value that corresponds to the average time value. That is, as discussed above, the controller 84 may use the average time value to determine the current I provided to the comparator component 96 of the circuit 200 and thus filter the noise present on the current I. As such, the controller 84 may use the current I to calibrate the pixel 94.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display device, comprising:

a pixel configured to display image data; and a circuit comprising:

a comparator component configured to change states when an input voltage crosses a threshold voltage;

a current source configured to provide a current to the comparator component;

a capacitor configured to couple across the comparator component, wherein the capacitor is configured to provide the input voltage to the comparator component when receiving the current; and a controller configured to:

open a switch configured to couple the current source to the comparator component when the comparator component changes states;

acquire a plurality of samples of a voltage output by the comparator component after the comparator component changes states;

determine an average value associated with the plurality of samples; and calibrate the pixel based on the average value.

2. The display device of claim 1, wherein the input voltage corresponds to a linear waveform.

3. The display device of claim 1, wherein the pixel comprises a self-emissive pixel.

4. A circuit, comprising:

a voltage source configured to output a first ramp digital-to-analog converter (DAC) voltage signal and a second ramp DAC voltage signal;

a comparator component configured to receive the first and second ramp DAC voltage signals and change states when either the first or second ramp DAC voltage signal crosses a threshold voltage;

a counter configured to provide a plurality of count values that corresponds to a plurality of voltage steps of the first and second ramp DAC voltage signals; and a controller configured to:

determine a range of voltages of the first ramp DAC voltage signal that corresponds to when the comparator component changes states when receiving the first ramp DAC voltage signal;

send a command to the comparator component to activate during the range of voltages when the comparator component receives the second ramp DAC voltage signal;

determine a voltage that corresponds to when the comparator component changes states with respect to the second ramp DAC voltage signal based on a count value of the plurality of count values, wherein the count value is associated with when the comparator component changes states with respect to the second ramp DAC voltage signal; and calibrate a pixel of a display device based on the voltage.

5. The circuit of claim 4, wherein the first ramp DAC voltage signal comprises fewer voltage steps as compared to the second ramp DAC voltage signal.

6. The circuit of claim 4, wherein the first and second ramp DAC voltage signals comprise a step down waveform or a step up waveform.

7. The circuit of claim 4, comprising a clock configured to cause the counter to increment each of the plurality of count values.

8. The circuit of claim 4, wherein the comparator component is configured to sample the first ramp DAC voltage signal at a first sampling rate and sample the second ramp DAC voltage signal at a second sampling rate that is different from the first sampling rate.

9. The circuit of claim 8, wherein the first sampling rate is slower than the second sampling rate.

10. The circuit of claim 4, wherein the voltage source is configured to output a third ramp DAC voltage signal after the second ramp DAC voltage signal, and wherein the controller is configured to:

send a command to the comparator component to activate during the range of voltages when the comparator component receives the third ramp DAC voltage signal;

determine a second voltage that corresponds to when the comparator component changes states with respect to the third ramp DAC voltage signal based on a second count value of the plurality of count values, wherein the second count value is associated with when the comparator component changes states with respect to the third ramp DAC voltage signal;

determine an average value of the voltage and the second voltage; and calibrate the pixel based on the average value.

11. The circuit of claim 10, wherein the second ramp DAC voltage signal is substantially the same as the third ramp DAC voltage signal.

12. The circuit of claim 4, wherein the controller is configured to determine the voltage by:

recording a first set of count values each time the comparator component changes states with respect to the second ramp DAC voltage signal; and determining an average value of the first set of count values; and determining the voltage based on the average value.

13. The circuit of claim 4, wherein the controller is configured to determine the voltage by comparing the count value to the second ramp DAC voltage signal.

14. A system, comprising:

a display comprising a plurality of pixels, wherein the display is configured to render image data;

a current source configured to output a current;

a comparator component configured to receive the current, wherein the current is configured to charge a capacitor coupled across the comparator component, and wherein the comparator component is configured to change states when a voltage signal output by the capacitor crosses a first threshold voltage or a second threshold voltage; and a controller configured to:

receive a first time that corresponds to a first instance that the comparator component changes states based on the voltage signal;

receive a second time that corresponds to a second instance that the comparator component changes states based on the voltage signal;

determine a first current value provided to the comparator component at the first time and a second current value provided to the comparator component at the second time; and calibrate a pixel of the plurality of pixels based on the first current value and the second current value.

15. The system of claim 14, wherein the comparator component is configured to activate for a first period of time associated with the first threshold voltage and a second period of time associated with the second threshold voltage.

16. The system of claim 15, wherein the first period of time is longer than the second period of time.

17. The system of claim 15, wherein the comparator component is configured to sample the voltage signal at a first sampling rate during the first period of time and at a second sampling rate during the second period of time.

18. The system of claim 17, wherein the second sampling rate is greater than the first sampling rate.

19. The system of claim 14, wherein the controller is configured:

determine an average value of the first current value and the second current value; and calibrate the pixel based on the average value.

20. A method, comprising:

receiving, via a processor, a plurality of time values that corresponds to a plurality of instances in which a comparator component changes states due to an input voltage signal crossing a threshold voltage, wherein the input voltage signal comprises a noise signal that causes the comparator component to change states at least a portion of the plurality of instances in which the comparator changes states, and wherein the plurality of time values is based on a clock signal;

determining, via the processor, an average value of the plurality of time values;

determining, via the processor, a voltage value of the input voltage signal that corresponds the average value; and calibrating, via the processor, a pixel of a plurality of pixels within a display device based on the voltage value.

21. The method of claim 20, wherein the plurality of time values is approximately distributed as a Gaussian function.

22. The method of claim 20, wherein determining the voltage value of the input voltage signal comprises, comparing the average value to the input voltage signal.

23. An electronic device, comprising:

a display panel comprising a plurality of pixels configured to display image data; and a voltage source configured to output a first ramp digital-to-analog converter (DAC) voltage signal and a second ramp DAC voltage signal;

a comparator component configured to receive first and second ramp DAC voltage signals and change states when either the first or second ramp DAC voltage signal crosses a threshold voltage;

a counter configured to provide a plurality of count values that corresponds to a plurality of voltage steps of the first and second ramp DAC voltage signals; and a controller configured to:

determine a range of voltages of the first ramp DAC voltage signal that corresponds to when the comparator component changes states when receiving the first ramp DAC voltage signal;

send a command to the comparator component to activate during the range of voltages when the comparator component receives the second ramp DAC voltage signal;

determine a voltage that corresponds to when the comparator component changes states with respect to the second ramp DAC voltage signal based on a count value of the plurality of count values, wherein the count value is associated with when the comparator component changes states with respect to the second ramp DAC voltage signal; and calibrate a pixel of a display device based on the voltage.

24. The electronic device of claim 23, wherein the voltage source is configured to output the second ramp DAC voltage signal after the first ramp DAC voltage signal.

* * * * *